US006341211B1

(12) United States Patent
Tsujimoto et al.

(10) Patent No.: US 6,341,211 B1
(45) Date of Patent: Jan. 22, 2002

(54) INDUCTIVE THERMAL FUSING DEVICE

(75) Inventors: Takahiro Tsujimoto, Toyokawa; Akinori Kimata, Toyohashi, both of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/613,897

(22) Filed: Jul. 11, 2000

(30) Foreign Application Priority Data

Jul. 15, 1999 (JP) ..... 11-202021

(51) Int. Cl.[7] ..... G03G 15/20
(52) U.S. Cl. ..... 399/330; 399/67
(58) Field of Search ..... 399/67, 69, 320, 399/328, 329, 330, 333, 335, 88

(56) References Cited

U.S. PATENT DOCUMENTS 5,778,293 A * 7/1998 Ohtsuka ..... 399/329
5,783,806 A * 7/1998 Hayasaki ..... 399/330 X
5,801,359 A * 9/1998 Mano et al. ..... 399/329 X
5,822,669 A * 10/1998 Okabayashi et al. ..... 399/330
6,055,403 A * 4/2000 Watanabe ..... 399/328
6,122,477 A * 9/2000 Parker ..... 399/330

FOREIGN PATENT DOCUMENTS

JP 9-96990 4/1997

* cited by examiner

*Primary Examiner*—Sandra Brase
(74) *Attorney, Agent, or Firm*—McDermott, Will & Emery

(57) ABSTRACT

The object of the present invention is to provide an inductive thermal fusing device that is reduced in size and weight based on a smaller closed magnetic circuit iron core. In order to attain this object, the present invention comprises a closed magnetic circuit iron core that forms a closed magnetic circuit, an inductive coil 14 that is wound such that it is linked to the closed magnetic circuit iron core and generates a magnetic flux that causes an inductive current that flows around the circumference of the conductive member, a power supply 50 that provides AC voltage to the inductive coil 14, a voltage detection means 7 that detects the voltage of the power supply 50, and a frequency changing means (first through fourth SSRs 51 through 54 and a CPU 5) that changes the frequency of the AC voltage applied to the coil 14 based on the detected voltage.

18 Claims, 6 Drawing Sheets

INDUCTIVE THERMAL FUSING DEVICE

RELATED APPLICATION

This application is based on application No. H11-202021 filed in Japan, the entire content of which is hereby incorporated by reference.

BACKGROUND OF THE INVENTION

1. Field of the Invention

The present invention pertains to a fusing device used in a copier, printer or facsimile machine based on the electrophotographic method, for example, and more particularly to a fusing device that fuses a toner image onto a recording medium by means of inductive heating.

2. Description of the Related Art

A fusing device that fuses onto a sheet of paper or transfer medium comprising a recording medium a toner image held on them is mounted in an image forming apparatus such as a copier, printer or facsimile machine that uses the electrophotographic method.

Various methods are used by the fusing device, but in response to the recent demand for low energy consumption, fusing devices employing the inductive heating method, which offers a higher conversion efficiency than that available in devices that use a halogen lamp as the heat source, have been proposed.

Fusing devices that use the inductive heating method have, as disclosed in Japanese Laid-Open Patent Application Hei 10-207265, a fixed or movable hollow conductive member, a closed magnetic circuit iron core, part of which is inserted into the empty space of the conductive member and which forms a closed magnetic circuit, and an inductive coil that is wrapped around the closed magnetic circuit iron core, such that the flow of electric current in the inductive coil generates a magnetic flux that gives rise to an inductive current that flows around the circumference of the conductive member, thereby inductively heating the conductive member.

However, fusing devices using this type of inductive heating method have the problem that the closed magnetic circuit iron core inside them requires that space for their mounting be created inside the device, making them large in size. In addition, because the closed magnetic circuit iron core is heavier than a halogen lamp, the member used to hold it must be sufficiently rigid to hold this weight, making the device more expensive.

Further, roller-type fusing devices also have the problem that because the roller diameter increases to accommodate the cross-sectional area of the closed magnetic circuit iron core, the curvature of the roller is large, and it consequently becomes difficult to separate the paper from the roller.

SUMMARY OF THE INVENTION

The object of the present invention is to provide an inductive thermal fusing device in which the fusing device itself may be made more compact and lightweight by reducing the size of the closed magnetic circuit iron core, and in which the separability of the paper based on the roller curvature may be improved where rollers are used.

These and other objects are attained by means of an inductive thermal fusing device comprising:

a cylindrical conductive member for applying heat to a recording medium holding toner;

an iron core which is inserted into the empty space inside the conductive member;

a coil wrapped around the iron core and along the length of the empty space inside the conductive member;

a power supply for supplying AC voltage to the coil; and a modulator for changing the frequency of the AC voltage provided by the power supply.

These and other objects are also attained by the inductive thermal fusing device described above, said device further comprising a pressure member for directly or indirectly pressing the recording medium onto the conductive member, These and other objects are also attained by the inductive thermal fusing device described above, said device further comprising a voltage detection circuit for detecting the voltage provided to the coil by the power supply, wherein the modulator changes the frequency based on the results of the detection by the voltage detection circuit.

These and other objects are also attained by the inductive thermal fusing device described above, wherein the modulator further has solid state relays connected in a bridge fashion and a CPU for controlling their switching, the detection circuit has a voltage detection resistor in which a prescribed voltage level is set and an operational amplifier for comparing the voltage level set in the voltage detection resistor and the level of voltage provided and rectified by the power supply, and outputs the result of the comparison to the CPU, and the CPU controls the switching of the solid state relays based on this output.

These and other objects are attained by means of an image forming apparatus comprising:

a toner image forming unit for forming a toner image on a photoreceptor;

a transfer unit for transfering the toner image formed on the photoreceptor onto a recording medium;

a power supply for providing AC voltage;

a modulator for changing the frequency of the AC voltage provided by the power supply; and a fusing unit for fusing the toner image transferred to the recording medium onto the recording medium, wherein the fusing unit comprise a cylindrical conductive member for applying heat to a recording medium holding toner;

an iron core which is inserted into the empty space inside the conductive member;

a coil connected to the power supply and wrapped around the iron core and along the length of the empty space inside the conductive member; and a pressure member for directly or indirectly pressing the recording medium onto the conductive member.

These and other objects are also attained by means of an inductive thermal fusing device comprising:

a fixed or movable hollow conductive member;

a pressure member for directly or indirectly pressing the recording medium holding toner onto the conductive member;

a closed magnetic circuit iron core, part of which is inserted into the empty space of the conductive member, and which forms a closed magnetic circuit:

an inductive coil that is wrapped around the closed magnetic circuit iron core, such that it is linked to the iron core, said coil generating a magnetic flux that gives rise to inductive current that flows around the circumference of the conductive member;

a power supply for providing AC voltage to the inductive coil; and a modulator for modulating the frequency of the AC voltage provided to the inductive coil by the power supply.

These and other objects are also attained by the inductive thermal fusing device described above, wherein the modulator comprises a voltage detection circuit that detects the AC voltage provided to the inductive coil by the power supply and modulates the frequency of the voltage provided to the inductive coil by the power supply based on the voltage detected by the voltage detection circuit.

These and other objects are also attained by the inductive thermal fusing device described above, wherein the modulator comprises a current detection circuit that detects the electric current that flows in the inductive coil due to the power supply and modulates the frequency of the voltage provided to the inductive coil by the power supply based on the electric current detected by the current detection circuit.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawings.

DESCRIPTION OF THE PREFERRED EMBODIMENT

An embodiment of the present invention is explained below with reference to the accompanying drawings.

Figure 1:
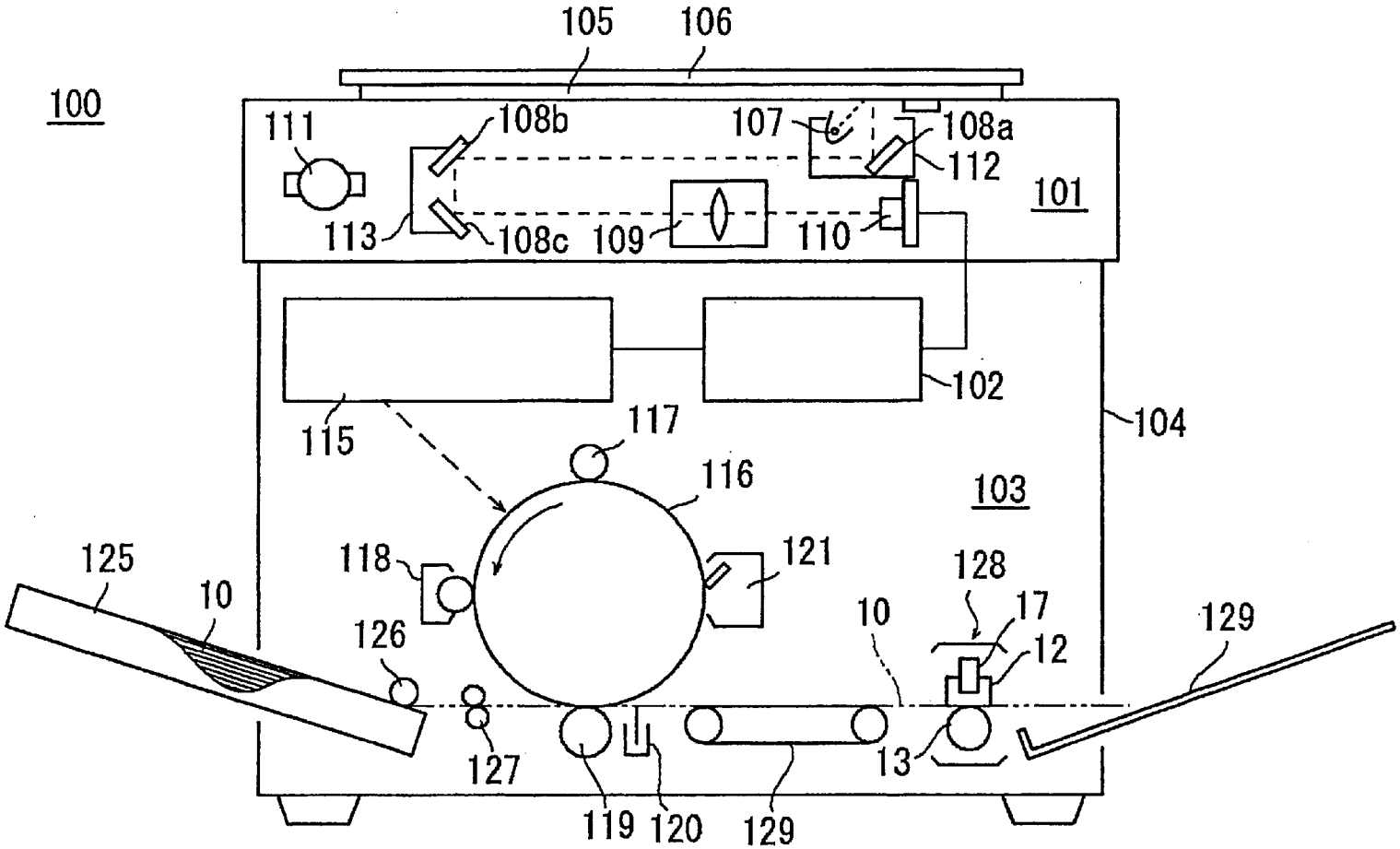
FIG. 1 shows the basic construction of a copying machine in which the inductive thermal fusing device pertaining to the present invention is used.

FIG. 1 shows the basic construction of a copying machine comprising an image forming apparatus incorporating the inductive thermal fusing device pertaining to the present invention. The copying machine 100 has, as shown in the drawing, an image scanner 101 that reads the original document, a signal processor 102 that performs signal processing, a printer 103 that prints out the image corresponding to the original document image read by the image scanner 101 onto a sheet 10 comprising a recording medium, and a casing 104 that houses these various components.

In the image scanner 101, the original document placed on the platen glass 105 is pressed by the platen cover 106, but when an automatic original document feeder—which is not shown in the drawing—is mounted, the automatic original document feeder replaces the platen cover 106. The original document on the platen glass 105 is illuminated by the lamp 107, and the light reflected by the original document forms an image on the CCD line image sensor 110 via the mirrors 108*a*, 108*b* and 108*c* and convergence lens 109, and is then converted into image information and sent to the signal processor 102. The first slider 112 and the second slider 113 mechanically move in the direction perpendicular (the secondary scanning direction) to the electric scanning direction (the main scanning direction) of the line image sensor 110 based on the driving of the scanner motor 111, and scans the entire surface of the original document. During this scanning, the first slider 112 moves at a speed (v) while the second slider 113 moves at a speed (v)/2.

The signal processor 102 electrically processes the signals read by the line sensor 109 and sends them to the printer 103. The printer 103 has a laser generator 115 and a photoreceptor drum 116 comprising an image carrier, and around the rotating photoreceptor drum 116 are located a charger roller 117 comprising a charging device, a developing device 118, a transfer roller 119 comprising a transfer device, a discharge pole 120 comprising a discharge and separation device for the sheet 10, and a cleaning device 121 that removes the toner remaining on the photoreceptor drum 116. The laser generator 115 drives and modulates the semiconductor laser in response to the level of the image signal sent from the signal processor 102. A laser beam is irradiated onto the photoreceptor drum 116 in the area between the charger roller 117 and the developing device 118 by means of a polygon mirror, f-θ lens and reflection mirror not shown in the drawing. The static latent image formed on the photoreceptor drum 116 is developed using toner by means of the developing device 118.

On the other hand, multiple stacked sheets 10 are housed in the paper supply cassette 125 detachably mounted to the casing 104. The sheets 10 in the paper supply cassette 125 are drawn in and supplied by the paper supply roller 126 one by one and sent towards the transfer position between the photoreceptor drum 116 and the transfer roller 119 at a prescribed time by the timing roller 127. The image developed on the photoreceptor drum 116 is transferred onto the sheet 10 by the transfer roller 119. The sheet 10, having undergone transfer, is separated from the photoreceptor drum 116 and conveyed towards the fusing device 128 by the conveyor belt 129. The unfused toner transferred to the sheet 10 is fixed and fused by the fusing device 128, and the sheet 10, on which toner is now fused, is ejected onto the paper eject tray 129. The fusing device 128 of this embodiment uses the low-frequency inductive heating method, and its construction is described below.

When image transfer onto the sheet 10 is finished by the transfer roller 119, the surface of the photoreceptive drum 116 is charged by a pre-cleaner charger, which is not shown in the drawing, so that its polarity becomes negative. The residual toner is then removed by the cleaning device 121, and the residual charge is removed by the eraser. The surface of the photoreceptive drum 116 is then charged again by the charger roller 117. A latent image is formed by means of the laser beam, the image is developed by the developing device 118, and the charge in the non-developed areas is removed by a pre-transfer eraser, which is not shown in the drawing.

Figure 2:
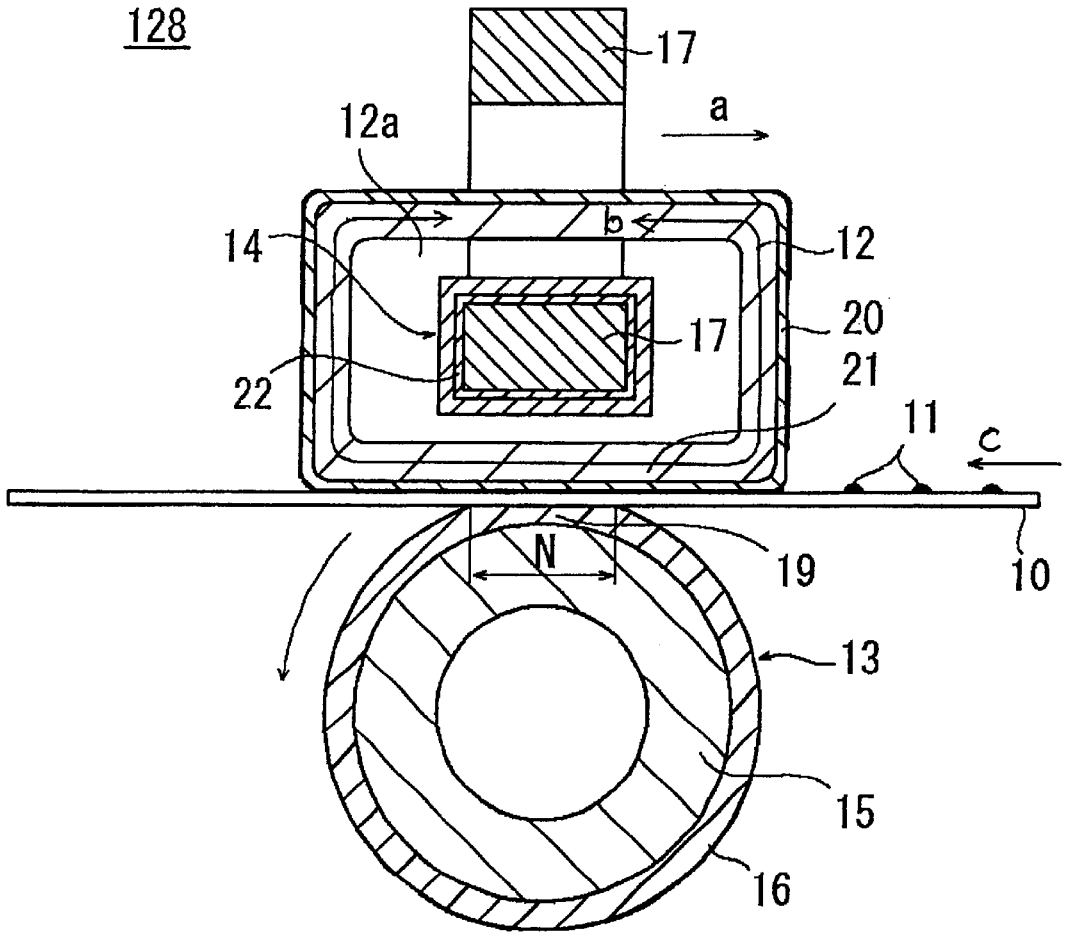
FIG. 2 is a drawing showing the construction of the inductive thermal fusing device.
Figure 3:
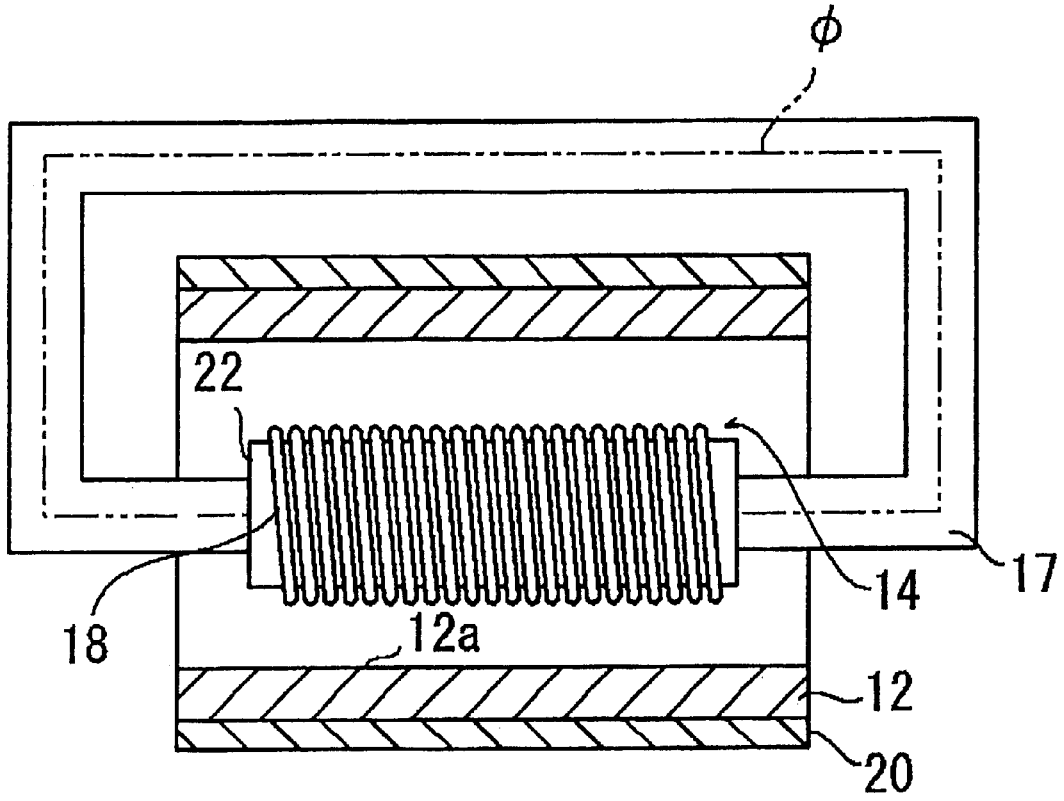
FIG. 3 is a cross-sectional view showing the important components of the inductive thermal fusing device.

FIG. 2 shows the construction of the inductive thermal fusing device, and FIG. 3 is a cross-sectional view showing important components of this fusing device. The inductive thermal fusing device 128 bonds the toner 11 held on the sheet 10 onto the sheet 10 by heating and melting the toner, and comprises a hollow temperature increasing member 12 fixed so that it does not rotate (this comprises the conductive member), a pressure roller 13 that indirectly presses the sheet 10 holding the toner onto the temperature increasing member 12 (this comprises the pressure member), a conveyor belt 20 that is located between the fixed temperature increasing member 12 and the pressure roller 13 and conveys the sheet 10, and an inductive coil 14 that performs inductive heating of the temperature increasing member 12 (hereinafter simply called 'the coil'). The conveyor belt 20 is located so that it can move in the direction of the arrow (a) in FIG. 2, and the pressure roller 13 rotates as the conveyor belt 20 and the sheet 10 move.

The temperature increasing member 12 comprises a conductive hollow pipe. It is formed using a carbon steel pipe, stainless alloy pipe, aluminum pipe or iron pipe, for example, and has a thickness that ensures a sufficient mechanical strength against the pressure from the pressure roller 13 and allows a sufficient thermal capacity. Both ends of the temperature increasing member 12 are fixed to the frame of the fusing unit, which is not shown in the drawings. In particular, the temperature increasing member 12 is formed to have a rectangular configuration so that the surface that faces the pressure roller 13 comprises a flat part 21. This flat part 21 increases the nipping width or nipping area N that holds the sheet 10 between the temperature increasing member 12 and the pressure roller 13. The pressure roller 13 comprises a core shaft 15 and a silicone rubber layer 16 that is formed around the core shaft 15. The silicone rubber layer 16 is a rubber layer that allows the sheet 10 to easily separate from its surface is heat-resistant. The pressure roller 13 is pressed in the direction of the temperature increasing member 12 by means of a spring member not shown in the drawings.

The conveyor belt 20 is wrapped around the outer circumference of the rectangular temperature increasing member 12, and a drive roller, which is not shown in the drawings, is in pressure contact with the conveyor belt. The conveyor belt 20 rotates by means of a drive source, which is not shown in the drawings, such as a motor connected to this drive roller, while using the temperature increasing member 12 as a guide panel. The conveyor belt 20 is formed of a pliable insulating material such as heat-resistant resin so that it is not inductively heated. In addition, a separating layer that has good toner separability and heat resistance is formed on the outer surface of the conveyor belt 20 by a coating of fluororesin so that the sheet 10 may be easily separated.

The inductive thermal fusing device 128 further has a rectangular core 17, which comprises a closed magnetic circuit, (this comprises the closed magnetic circuit iron core), and part of the core 17 runs through the empty space 12*a* of the temperature increasing member 12. The core 17 is a so-called iron core that is used in a regular transformer, and preferably has a high amplitude permeability like the layered silicon steel plate iron core, for example. The coil 14 is located around the core 17 and inside the temperature increasing member 12. The coil 14 comprises wire 18 that is wound in a spiral fashion, and the wire 18 comprises a regular single lead wire that has a fusion layer and a insulating layer on the surface. There is a heat insulating layer 22 in the coil 14, so that the heat generated in the temperature increasing member 12 and the coil 14 is not transmitted to the core 17.

The basic operation of the fusing device described above will now be explained. When AC power is applied to the coil 14 from the power supply circuit and an electric current begins to flow, a magnetic flux that causes an inductive current to flow around the circumference (the direction of the arrow (b)) of the temperature increasing member 12 is generated in the core 17. Consequently, the temperature increasing member 12 is heated based on low-frequency induction until it reaches a temperature appropriate for carrying out the fusing operation (150°–200° C., for example). The sheet 10 on which unfused toner 11 is held is conveyed from the right hand side, as shown by the arrow (c) in FIG. 2, and is sent towards the nipping area 19, which is the contact area between the temperature increasing member 12 and the pressure roller 13. The sheet 10 is conveyed while being held by the nipping area 19 and receives heat from the heated temperature increasing member 12, as well as pressure from the pressure roller 13. Consequently, the unfused toner 11 becomes fused onto the sheet 10. The toner 11 is held on the side of the sheet 10 that comes into contact with the conveyor belt 20. The sheet 10 that has passed through the nipping area 19 separates naturally from the conveyor belt 20 due to its own rigidity and is conveyed towards the left hand side in FIG. 2. This sheet 10 is conveyed by the eject roller and ejected onto the paper eject tray 129.

The principle of operation of the inductive thermal fusing device having the construction described above is identical to that of a transformer. The coil 14 corresponds to the primary side coil (N winding) on the input side and the temperature increasing member 12 corresponds to the secondary side coil (1 winding) on the output side. When AC voltage Vl is applied to the primary side coil (the coil 14), an electric current 11 flows in the primary side coil. The magnetic flux ø that is consequently generated flows in the core 17 that forms a closed magnetic circuit, which then generates an inductive electromotive force V2 in the secondary side coil (the temperature increasing member 12), and an electric current 12 flows around the circumference of the temperature increasing member 12. Because a closed magnetic circuit is formed, theoretically there is no leak of the magnetic flux, and the primary side energy V1×11 and the secondary side energy V2×12 become essentially the same. The areas that generate heat in this system based on this inductive heating are (1) the coil due to the copper loss in the copper wire of the primary side coil, i.e., heat generation from the coil 14 itself, (2) the coil due to the copper loss in the copper wire of the secondary side coil, i.e., heat generation from the temperature increasing member 12 due to the inductive heating, and (3) the core 17 due to the Joule heat loss and hysterisis loss that occur inside the core. In the inductive thermal fusing device, the first and third types of heat generation is controlled to the minimum possible because it results in energy loss while heat generation from the temperature increasing member 12 is caused using the second copper loss.

Figure 4:
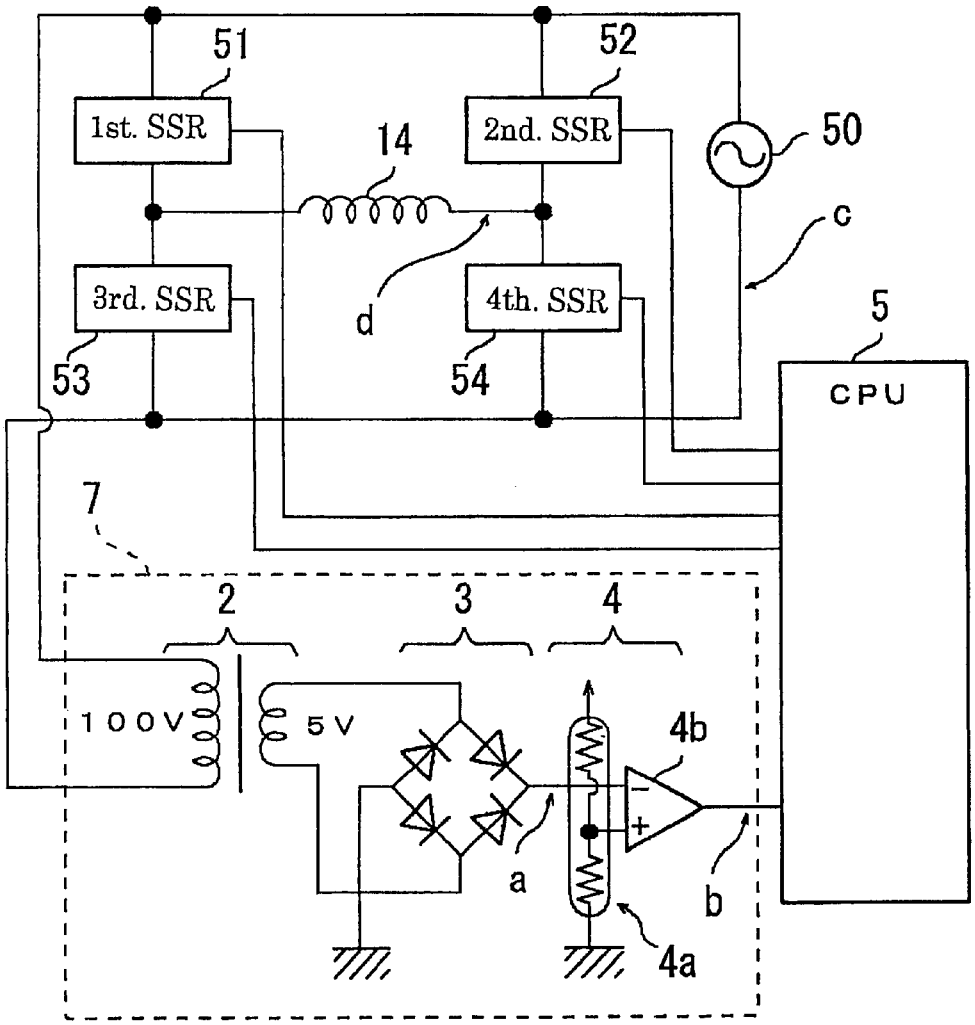
FIG. 4 is a diagram of the power supply circuit in the inductive thermal fusing device.

FIG. 4 is a drawing showing the construction of the circuit to supply power to the coil 14. As shown in the drawing, first through fourth SSRs (solid state relays) 51 through 54, which comprise switches, are connected to the coil 14 in a bridge fashion, and the AC voltage from the power supply 50 is supplied based on the switching operation of these SSRs 51 through 54. This circuit also has a voltage detection means 7 that detects the AC voltage output from the power supply 50. The power from a commercial power supply (such as AC100V/50 Hz power) is supplied to the power supply 50 as is. The device pertaining to the present invention is an inductive thermal fusing device that uses such a low-frequency AC power supply. Here 'low-frequency' refers to a range within approximately 40 Hz to 70 Hz.

Switching of the SSRs 51 through 54 is performed based on control signals from the CPU 5. The first SSR 51 and the fourth SSR 54 are switched as a pair, as are the second SSR 52 and the third SSR 53. Based on this switching operation, the direction of the electric current applied to the coil 14 is changed back and forth. SSRs are used here in order to prevent noise from the commercial power supply from entering the electric system such as the CPU and other control systems, and to prevent the power from the commercial power supply from directly entering other electric systems in the cause of failure, because the power from a commercial power supply is used directly to supply power to the coil. However, so long as control can be performed so that the electric system for the inductive coil and other electric systems can be electrically separated, anything, such as photocouplers, for example, may be used instated of SSRs.

The voltage detection means 7 comprises a transformer 2, a rectifying circuit 3 and a voltage level detection circuit 4. The voltage level detection circuit 4 indirectly detects the AC voltage applied to the coil 14 from the power supply 50. The AC voltage from the power supply 50 (100 V) is stepped down to 5 V by means of the transformer 2, and undergoes full wave rectification by means of a single phase bridge rectifying circuit 3 comprising multiple diodes. The voltage level detection circuit 4 compares the voltage set by the voltage detection resistor 4*a* and the post-rectification voltage level by means of an operational amplifier 4*b,* and outputs an ON or OFF signal based on whether the post-rectified voltage level equals or exceeds a certain level. Here, where the post-rectification voltage level equals or exceeds a certain level, an OFF signal is output, and where it is less than a certain level, an ON signal is output. The signal output from the operational amplifier 4*b* is input to the CPU 5.

The CPU 5 detects the edges of the ON or OFF signal from the operational amplifier 4*b,* and switches the SSRs 51 through 54 when an edge is detected. Where the first SSR 51 and the fourth SSR 554 are ON and the second SSR 52 and the third SSR 53 are OFF, for example, the state is inverted when an edge is detected, so that the first SSR 51 and the fourth SSR 54 become OFF and the second SSR 52 and the third SSR 53 become ON. When the next edge is detected, this state is inverted once more.

Figure 5:
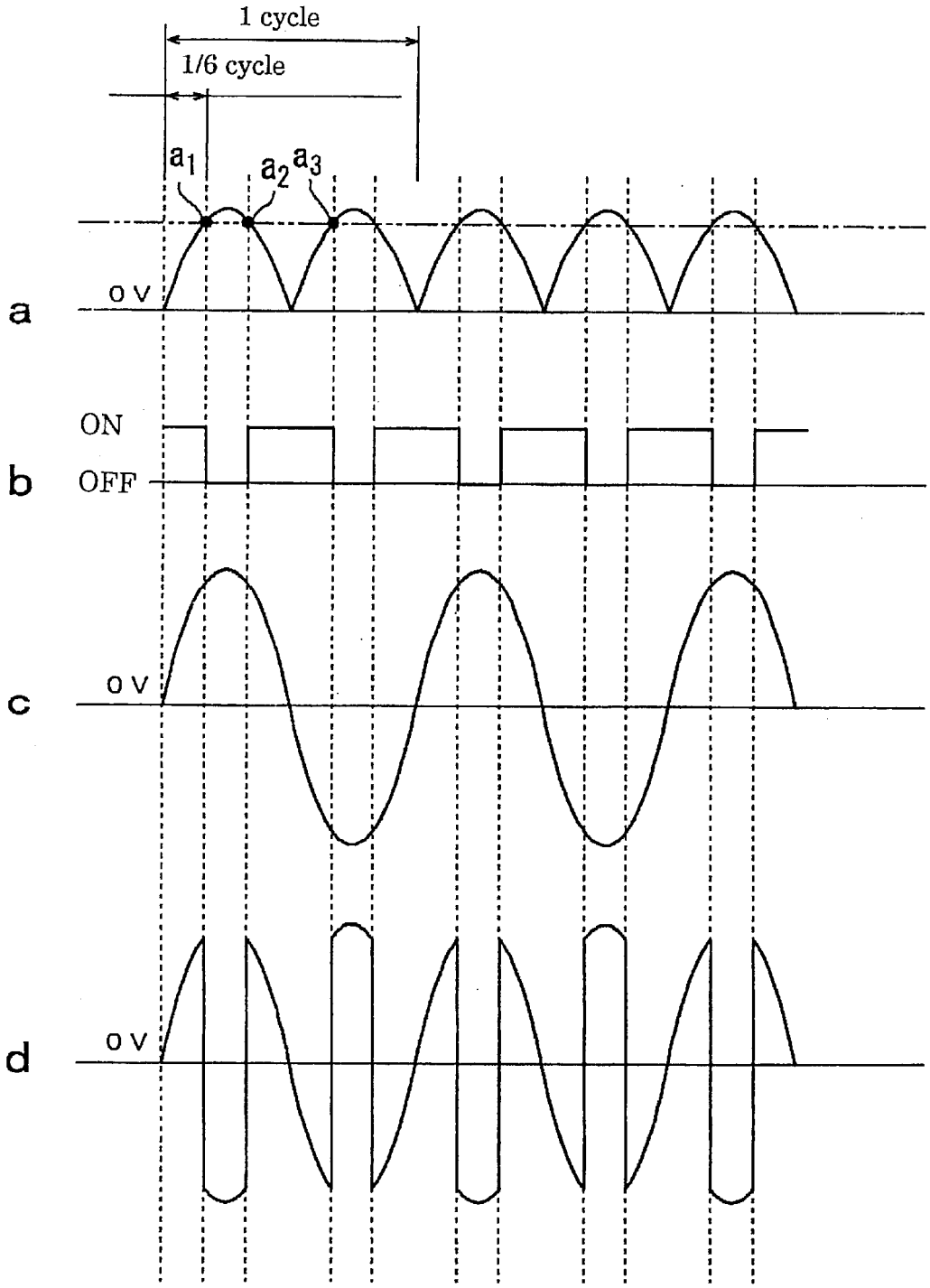
FIG. 5 is a drawing showing the current waveforms at points (a), (c) and (d) in FIG. 4 and the signal waveform at point (b).

FIG. 5 is a drawing showing current waveforms at points (a), (c) and (d) in the circuit drawing of FIG. 4, and a signal waveform at point (b). The horizontal axis represents time. At point (a), post-full wave rectification electric current is flowing. The voltage detection resistor 4*a* is set to the voltage level at point (a) at the time a1, which is the 1/6 cycle point of 50 Hz AC voltage. By doing so, the signal waveform at point (b) becomes OFF at the time al at which the AC voltage at point (a) reaches or exceeds the level attained at the 1/6 cycle point after increasing from the initial OV (1), becomes ON at the time a2 when the AC voltage at point (a) decreases below the level at the 1/6 cycle point (2), and becomes OFF at time point a3 when the AC voltage at point (a) reaches or excess the level at the 1/6 cycle point (3). Subsequently, ON and OFF signals repeatedly appear based on whether or not the AC voltage at point (a) equals or exceeds the level at 1/6 cycle point. At point (c), the AC voltage of the power supply 50 appears as is.

At point (d), switching of the SSRs 51 through 54 is performed by the CPU 5 that receives the output signal from the operational amplifier 4*b,* so that an electric current in which the direction of the current changes every 1/6 cycle point, i.e., an electric current having a frequency three times larger than 50 Hz, is obtained. The electric current at this point (d) is the power that is applied to the coil 14, and therefore, an 150 Hz AC voltage is applied to the coil 14. The inductive heating by means of short current is appropriately performed by making a low-frequency AC voltage of 40 Hz through 70 Hz to approximately ten times or more lower.

The operation that occurs in this embodiment will be explained below. Here, the relationship between the density of the magnetic flux formed in the core 17 and the frequency of the AC voltage applied to the coil will first be explained. Theoretically, the density B of the magnetic flux formed in the core is obtained using the following formula (1), assuming that there is no leakage.

$$B=V1/\ (4.44\times f\times N\times S) \tag{1}$$

Here, V1 is the AC voltage applied to the coil, (f) is the frequency of the AC voltage applied to the coil, N is the widing number of the coil, and S is the cross-sectional area of the core. If the frequency (f) is made (n) times larger, the magnetic flux density B' is obtained through the equation (2) below.

$$B'=V1/(4.44\times nf\times N\times S) \tag{2}$$

If the magnetic flux density B' is made the same as B in the equation (1) (i.e., B'=B), the cross-sectional area S of the core is expressed in the equation (3) below.

$$S/n=B'\times((4.44\times f\times N1)/V1) \tag{3}$$

Therefore, by making the frequency of the AC voltage applied to the coil (n) times larger, the cross-sectional area S of the core becomes 1/(n). Since the frequency is made three times larger than that of the commercial power supply in this embodiment, the cross-sectional area of the core can be made approximately one third of the area when the commercial power supply is used as is, which contributes to making the entire fusing device smaller and lighter.

Figure 6:
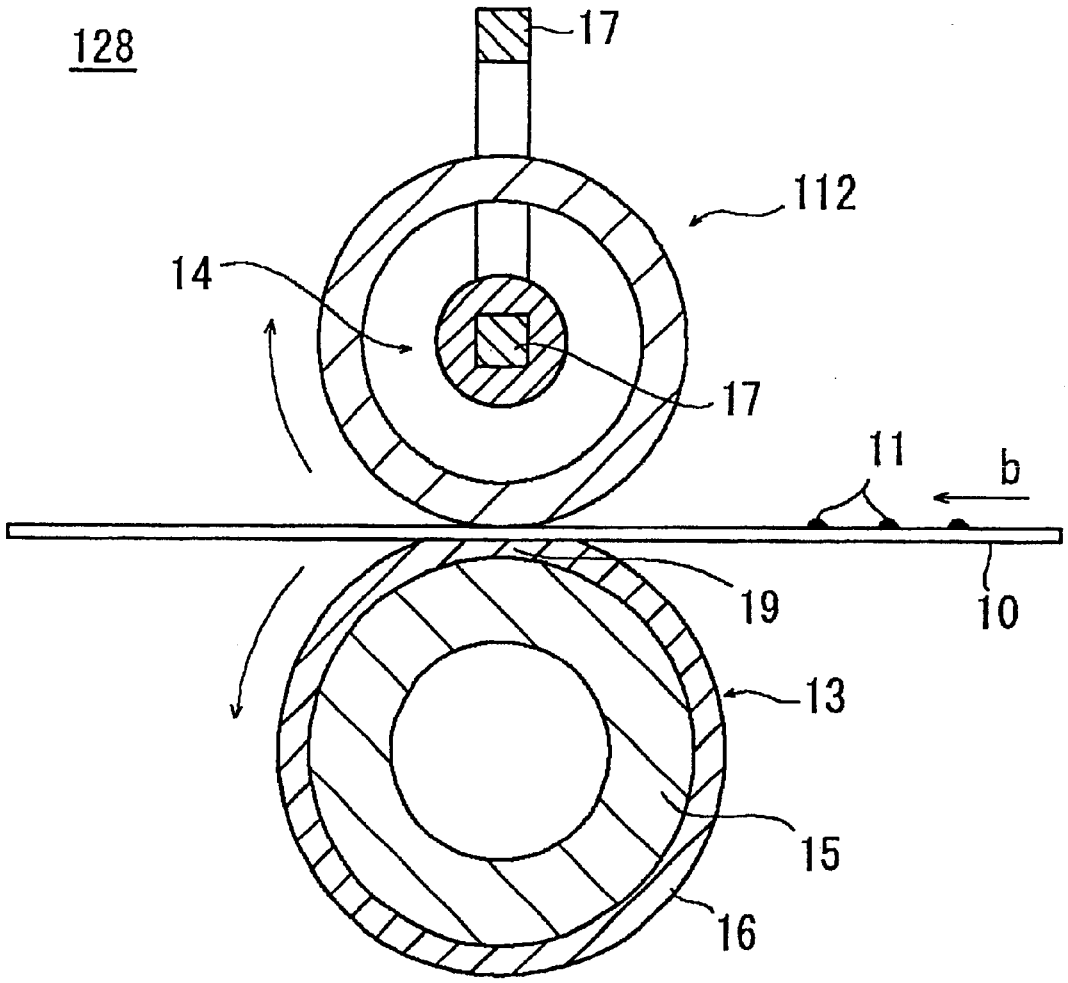
FIG. 6 is a cross-sectional view showing a roller-type inductive thermal fusing device.

In this embodiment, the temperature increasing member 12, through which the core 17 extends and which performs inductive heating, has an essentially rectangular configuration, but the present invention is not limited to this configuration. For example, the temperature increasing member may comprise a cylindrical roller as shown in FIG. 6, for example. In this case, the roller 112 comprises the conductive member, and part of the core 17 and coil 14 wound around the core 17 are located inside the roller 112, so that the roller 112 is inductively heated. The roller 112 is supported so that it can freely rotate, and rotates by means of a drive means not shown in the drawing. The surface of the roller is coated with fluororesin so that the sheet may easily separate from the roller. In FIG. 6, because the other components are identical to those shown in FIG. 2, the same numbers are used for them, and they will not be explained.

By applying the present invention in such a roller type inductive thermal fusing device, the cross-sectional area of the core 17 located inside the roller 112 may be made smaller and the diameter of the roller 112 itself may therefore be reduced, thereby reducing the curvature of the roller surface and helping the sheet to separate more easily from the roller.

In the embodiment described above, switching of multiple SSRs is performed based on the detection of the power supply voltage, but the same operation may be performed if the amount of electric current is detected instead. In the present invention, a frequency higher than that of the commercial power supply is obtained through the switching of multiple SSRs. This is carried out for the purpose of reducing energy loss. Therefore, in implementing the present invention, other devices such as inverters may be used instead so long as the energy loss is small.

As explained above, using the present invention, because the frequency of the AC voltage applied to the inductive coil may be changed by means of a frequency changing means so that the frequency is increased, if the density of the magnetic flux formed in the core remains the same, the cross-sectional area of the core may be made smaller. Therefore, the entire fusing device may be made smaller and lighter. In addition, because such a construction makes it unnecessary to use a highly rigid support member, cost reduction is also attained. Furthermore, by being able to reduce the cross-sectional area of the core, the diameter of the roller may also be reduced in a roller-type fusing device, allowing the curvature of the roller surface to be made smaller and contributing to better separation between the recording medium and the roller.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An inductive thermal fusing device comprising:

a conductive member for applying heat to a recording medium holding toner;

an iron core which forms a closed loop, and part of which is inserted into an empty space inside the conductive member;

a coil wrapped around the iron core and along the length of the empty space inside the conductive member;

a power supply for supplying AC voltage to the coil; and a modulator for changing the frequency of the AC voltage provided by the power supply.

2. The inductive thermal fusing device according to claim 1, wherein a magnetic flux is generated along the length of the empty space by having the power supply generate an electric current to flow in the coil.

3. The inductive thermal fusing device according to claim 2, wherein the flow of alternating current in the coil caused by the power supply causes the magnetic flux to generate an inductive current that flows around the circumference of the conductive member.

4. The inductive thermal fusing device according to claim 3, wherein the conductive member generates heat based on the inductive current.

5. The inductive thermal fusing device according to claim 1, said device further comprising a pressure member for directly or indirectly pressing the recording medium onto the conductive member.

6. The inductive thermal fusing device according to claim 1, wherein the conductive member has a cylindrical configuration.

7. The inductive thermal fusing device according to claim 1, said device further comprising a voltage detection circuit for detecting the voltage provided to the coil by the power supply, wherein the modulator changes the frequency based on the results of the detection by the voltage detection circuit.

8. The inductive thermal fusing device according to claim 1, wherein the modulator has a current detection circuit that detects the current that flows in the coil due to the power supply, and changes the frequency based on the results of the detection by the current detection circuit.

9. The inductive thermal fusing device according to claim 1, wherein the frequency of the voltage provided by the power supply is in the range of 40 to 70 Hz.

10. The inductive thermal fusing device according to claim 9, wherein the power supply is connected to a commercial power supply and the modulator increases the frequency of the voltage taken from the commercial power supply.

11. The inductive thermal fusing device according to claim 10, wherein the modulator increases the frequency of the voltage from the commercial power supply by a maximum of tenfold.

12. The inductive thermal fusing device according to claim 1, wherein the iron core forms a closed magnetic circuit that is linked to the conductive member.

13. An inductive thermal fusing device comprising:

a conductive member for applying heat to a recording medium holding toner;

an iron core which is inserted into an empty space inside the conductive member;

a coil wrapped around the iron core and along the length of the empty space inside the conductive member;

a power supply for supplying AC voltage to the coil;

a voltage detection circuit for detecting the voltage provided to the coil by the power supply; and a modulator for changing the frequency of the AC voltage provided by the power supply based on the results of the detection by the voltage detection circuit, wherein the modulator further has solid state relays connected in a bridge fashion and a CPU for controlling their switching, the detection circuit has a voltage detection resistor in which a prescribed voltage level is set and an operational amplifier for comparing the voltage level set in the voltage level set in the voltage detection resistor and the level of voltage provided and rectified by the power supply, and outputs the result of the comparison to the CPU, and the CPU controls the switching of the solid state relays based on this output.

14. The inductive thermal fusing device according to claim 13, wherein the modulator changes the frequency by changing the voltage level set in the voltage detection resistor.

15. An image forming apparatus comprising:

a toner image forming unit for forming a toner image on a photoreceptor;

a transfer unit for transferring the toner image formed on the photoreceptor onto a recording medium;

a power supply for providing AC voltage;

a modulator for changing the frequency of the AC voltage provided by the power supply; and a fusing unit for fusing the toner image transferred to the recording medium onto the recording medium, wherein the fusing unit comprises a cylindrical conductive member for applying heat to a recording medium holding toner;

an iron core which forms a closed loop, and part of which is inserted into an empty space inside the conductive member;

a coil connected to the power supply and wrapped around the iron core and along the length of the empty space inside the conductive member; and a pressure member for directly or indirectly pressing the recording medium onto the conductive member.

16. An inductive thermal fusing device comprising;

a fixed or movable hollow conductive member;

a pressure member for directly or indirectly pressing a recording medium holding toner onto the conductive member;

a closed magnetic circuit iron core, which forms a closed loop, part of which is inserted into an empty space of the conductive member, and which forms a closed magnetic circuit;

an inductive coil that is wrapped around the closed magnetic circuit iron core inside the conductive member, such that it is linked to the iron core, said coil generating a magnetic flux that gives rise to the inductive current that flows around the circumference of the conductive member;

a power supply for providing AC voltage to the inductive coil; and a modulator for modulating the frequency of the AC voltage provided to the inductive coil by the power supply.

17. The inductive thermal fusing device according to claim 16, wherein the modulator comprises a voltage detection circuit that detects the AC voltage provided to the inductive coil by the power supply and modulates the frequency of the voltage provided to the inductive coil by the power supply based on the voltage detected by the voltage detection circuit.

18. The inductive thermal fusing device according to claim 16, wherein the modulator comprises a current detection circuit that detects the electric current that flows in the inductive coil due to the power supply and modulates the frequency of the voltage provided to the inductive coil by the power supply based on the electric current detected by the current detection circuit.

* * * * *